US006003597A

United States Patent [19]

Newman

[11] Patent Number: 6,003,597

[45] Date of Patent: Dec. 21, 1999

[54] DIRECTIONAL COUPLING SENSOR FOR ENSURING COMPLETE PERFORATION OF A WELLBORE CASING

[76] Inventor: Frederic M. Newman, 1618 W. Dengar, Midland, Tex. 79705

[21] Appl. No.: 09/080,104

[22] Filed: May 16, 1998

[51] Int. Cl.[6] ..... E21B 43/119

[52] U.S. Cl. ..... 166/55.1; 166/66; 166/66.5

[58] Field of Search ..... 166/55, 55.1, 65.1, 166/66, 66.5, 297

[56] References Cited

U.S. PATENT DOCUMENTS

| | | | |
|---|---|---|---|
| 1,825,243 | 9/1931 | Moss . | |
| 2,698,920 | 1/1955 | Gieske . | |
| 3,040,808 | 6/1962 | Schramm . | |
| 3,064,571 | 11/1962 | True . | |
| 3,145,771 | 8/1964 | Pennebaker, Jr. . | |
| 3,209,828 | 10/1965 | Lebourg . | |
| 3,338,317 | 8/1967 | Shore . | |
| 3,393,732 | 7/1968 | Murphey, Jr. et al. . | |
| 3,977,917 | 8/1976 | Fujimura . | |
| 4,007,790 | 2/1977 | Henning . | |
| 4,082,582 | 4/1978 | Menth et al. . | |
| 4,515,010 | 5/1985 | Weido et al. . | |
| 4,537,255 | 8/1985 | Regalbuto et al. . | |
| 4,708,204 | 11/1987 | Stroud . | |
| 5,211,714 | 5/1993 | Jordan et al. | 166/297 |
| 5,259,466 | 11/1993 | Venditto et al. | 166/55.1 |
| 5,382,303 | 1/1995 | Anderson et al. . | |

*Primary Examiner*—Roger Schoeppel
*Attorney, Agent, or Firm*—Robert J. Harter

[57] ABSTRACT

A directional collar locator sensor distinguishes between an outer casing collar from an inner pipe coupling deep within a wellbore by selectively positioning a semi-spherical magnetic shield about a magnetic sensor. The collar locator has virtually no moving parts and facilitates conventional logging, perforating multiple completion wellbores, and splitting of casing collars and inner pipe couplings. When used in perforating a well casing, the directional sensor ensures that the perforating gun is pointed in the right direction to produce complete perforations as opposed to just producing dents.

25 Claims, 14 Drawing Sheets

DIRECTIONAL COUPLING SENSOR FOR ENSURING COMPLETE PERFORATION OF A WELLBORE CASING

BACKGROUND OF THE INVENTION

1. Field of the Invention

The subject invention generally pertains to locating couplings (or collars) within a wellbore, and more specifically to distinguishing between the couplings on the internal and external piping.

2. Description of Related Art

Many wellbores consist of a pipe within a pipe. The outer one is generally referred to as an "outer casing" or "production string" and is typically made up of 40 to 45 foot sections coupled together by way of "casing collars." The inner one, of 30 to 33 foot lengths, is called an "inner pipe string," and it is interconnected by "pipe couplings." It becomes necessary to both locate and distinguish which couplings belong to which string of pipe deep within a wellbore for the purpose of logging, perforating, or disassembly and repair.

With existing coupling sensors, it can be difficult to distinguish between casing collars and pipe couplings. Some sensors may have external hardware that properly orients the sensor in relation to the inner pipe string. However, the hardware often hangs up within the limited space of a well. Space is especially limited in multiple string wells, such as the one illustrated in U.S. Pat. No. 3,064,571 which is specifically incorporated by reference herein.

An even greater problem exists when attempting to perforate the outer casing of a wellbore. To effectively perforate a well casing, it is critical to have the face of the perforating gun up against the inner wall of the casing. Otherwise, the stand-off distance between the face of the gun and the casing wall becomes too great. Exceeding the design stand-off distance even slightly can reduce the gun's explosive impact force to a level so low that the gun fails to perforate the casing. Magnets and other mechanisms can be used to urge the gun to its proper orientation. But when those fail, one can be misled to believe that complete perforation was accomplished, because the gun still discharges. It is difficult to determine whether any perforation occurred.

SUMMARY OF THE INVENTION

To overcome the limitations of existing collar locators, it is a primary object of the invention to directionally focus a collar locator without the use of moving parts that tend to hang up or otherwise malfunction.

A second object is to provide a collar locator that is sufficiently slender to fit through an inner string of a multiple string well.

A third object is to distinguish between outer casing collars and inner pipe coupling by selectively repositioning a magnetic shield in relation to an exterior magnet that holds the collar locator against the inner wall of an outer casing.

A fourth object is to provide a directional collar locator that is compatible with a variety of operations such as logging, perforating, and splitting (disassembly).

A fifth, and possibly most important, object of the invention is to provide an operator with feedback that indicates when a perforation tool is properly oriented within a wellbore to effectively perforate the outer casing of the well.

These and other objects of the invention are provided by a novel directional collar locator having a magnetic shield that directs the focus of the collar locator sensor in relation to a magnet that holds the collar locator in proper orientation against an inner wall of an outer casing.

DESCRIPTION OF THE PREFERRED EMBODIMENT

Figure 1:
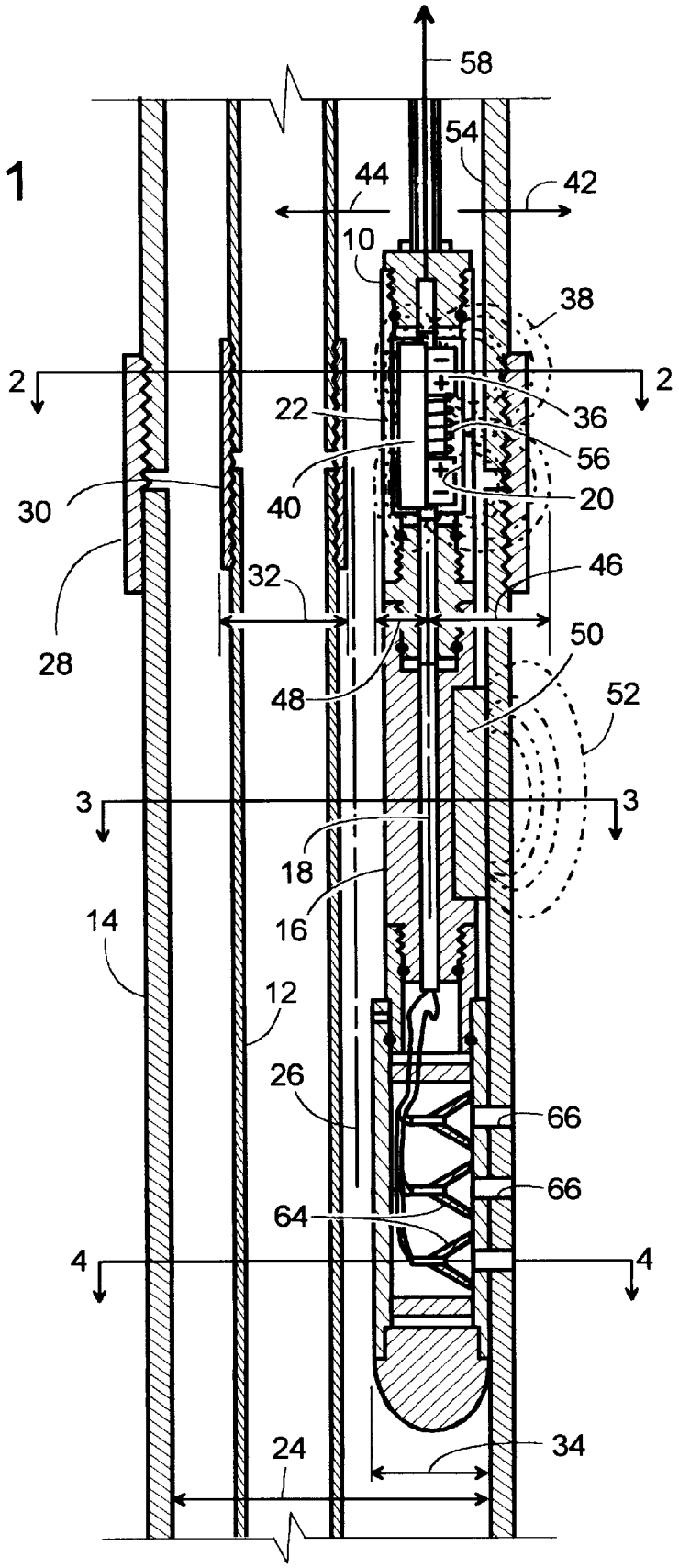
FIG. 1 is a cross-sectional view of the invention taken along line 1—1 of FIG. 3.
Figure 2:
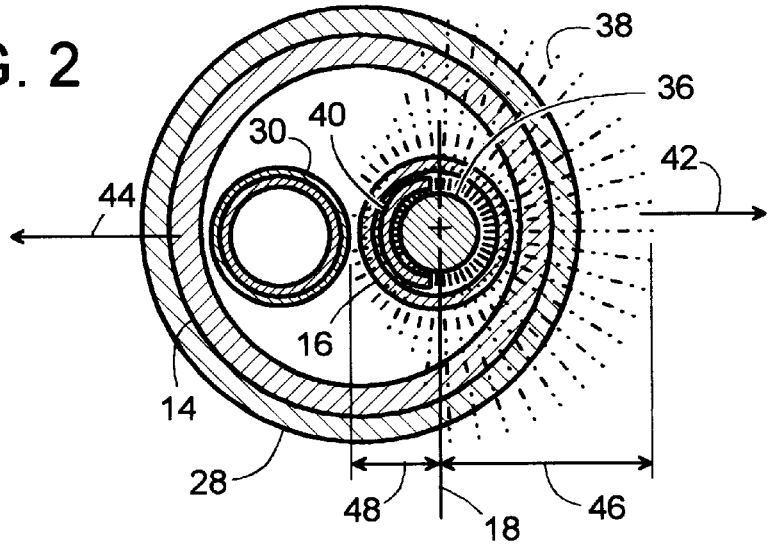
FIG. 2 is a cross-sectional view of the invention taken along line 2—2 of FIG. 1.
Figure 3:
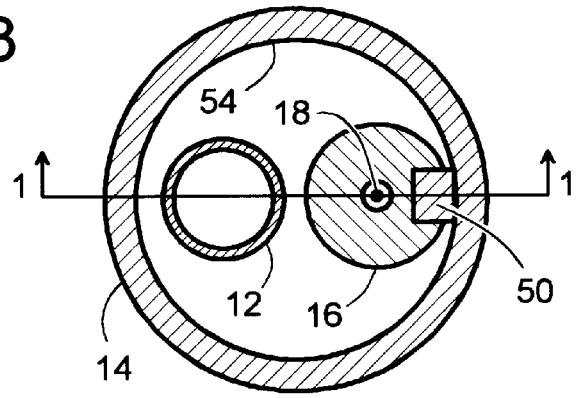
FIG. 3 is a cross-sectional view of the invention taken along line 3—3 of FIG. 1.
Figure 4:
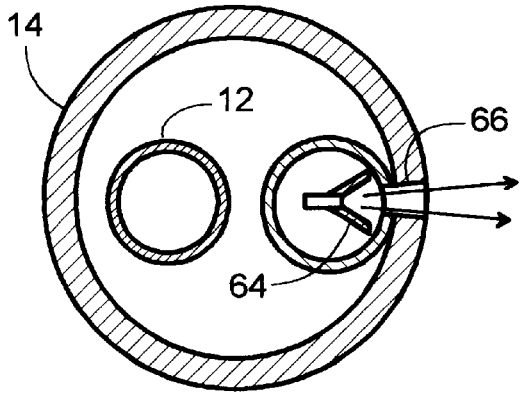
FIG. 4 is a cross-sectional view of the invention taken along line 4—4 of FIG. 1.

A directional collar locator 10 inside a buried well casing 14 and situated along side an internal pipe string 12 is shown in FIGS. 1–4. Well casing 14 has an inside diameter 24, a casing longitudinal centerline 26, and at least one ferrous casing collar 28. Pipe string 12 has at least one ferrous pipe coupling 30 that has a coupling outside diameter 32. Collar locator 10 comprises a tubular housing assembly 16 that extends generally the full length of collar locator 10. Tubular housing 16 is centrally disposed about a housing longitudinal centerline 18 and has a housing outside diameter 34 that is less than the difference of the casing inside diameter 24 minus the coupling outside diameter 32.

Housing 16 also includes a chamber 20 with a non-magnetic wall 22. The term, "non-magnetic," as used herein and below, refers to a material that is not drawn to a magnet. A first magnet 36 is hermetically sealed within chamber 20 and has a first magnetic field 38.

A semi-cylindrical ferrous (e.g., mild steel) shield 40 is disposed partially around magnet 36 to ensure that magnetic field 38 projects farther in a forward direction 42 than in an opposite rearward direction 44, as indicated by dimensions 46 and 48 respectively. The distance to which field 38 extends is defined as that distance from centerline 18 at which field 38 diminishes to less than a predetermined low value (e.g., 5% of its maximum intensity). The "forward direction" is generally opposite shield 40.

A second magnet 50 having a second magnetic field 52 is attached to housing 16, outside of chamber 20. Magnet 50 is radially offset from centerline 18 to draw collar locator 10 in either the forward 42 or rearward direction 44 against an inner wall 54 of casing 14. In the embodiment of FIG. 1, magnet 50 is situated to draw collar locator 10 in the forward direction 42 so that magnetic field 38 is aimed toward casing collar 28 as opposed to pipe coupling 30 (assuming proper vertical alignment).

An electrical circuit 56 (e.g., a coil) exposed to field 38 is hermetically sealed within chamber 20. By way of induction, circuit 56 provides a feedback signal 58 that changes upon disturbing field 38. In the embodiment of FIG. 1, field 38 is disturbed by collar locator 10 being lowered past ferrous casing collar 28. This principle is well known and commonly used in a variety of ways by those skilled in the art. The strategic location of shield 40 in relation to magnet 50 allows collar locator 10 to detect casing collar 28 and mostly ignore pipe coupling 30.

In the embodiment of FIGS. 1–4, collar locator 10 includes several spaced-apart explosives 64 that point in forward direction 42 to create several perforations 66 in casing 14. For clarity, perforations 66 are shown in casing 14 and housing 16 even though they would not actually appear until after charges 64 detonate. This embodiment of the invention enables an operator to confirm that explosives 64 are pointing in the right direction. Collar locator 10 detecting a casing collar 28 indicates that collar locator 10 is properly oriented up against the inside wall of well casing 14, and therefore, so are explosives 64. If explosives 64 were not properly facing the inside wall of casing 14, an excessive stand-off gap can exist between the face of explosives 64 and the inside wall of casing 14. An excessive stand-off gap can diminish the impact of explosives 64 to a level below that which is needed to actually perforate casing 14.

Explosives 64 are conventional perforation tools well known to those skilled in the art. Some examples of explosives 64 are provided by Owen Oil Tools Incorporated, of Fort Worth, Texas.

Figure 8:
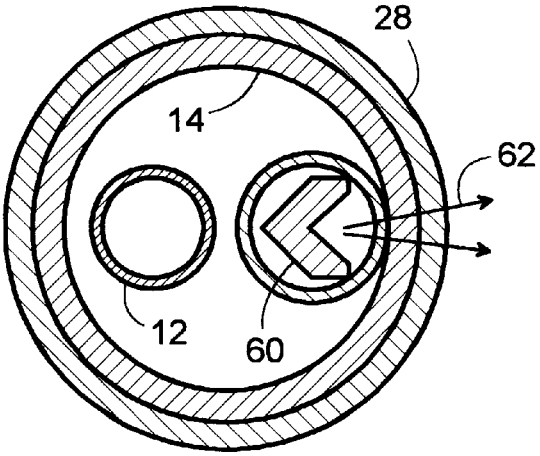
FIG. 8 is a cross-sectional view of the invention taken along line 8—8 of FIG. 5.

Another collar locator 10' of FIGS. 5–8 is very similar to that of FIGS. 1–4; however, an elongated explosive charge 60 replaces point charges 64. Charge 60 has an elongated shape for longitudinally splitting casing collar 28 to facilitate the disassembly of well casing 14. FIG. 8 illustrates the generally unidirectional discharge 62 of explosive charge 60. The function and other features of collar locator 10' are further explained in Frederic M. Newman's U.S. Pat. No. 5,720,344 which is specifically incorporated by reference herein.

Figure 9:
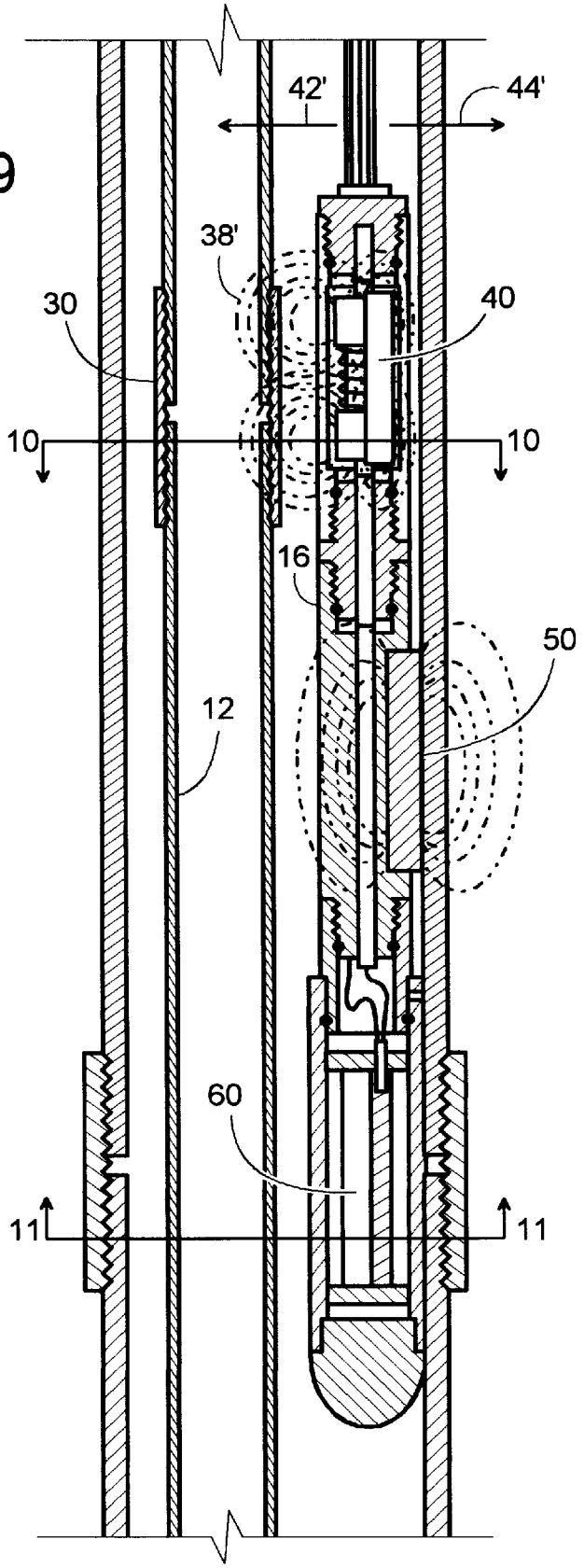
FIG. 9 is a cross-sectional view of another embodiment of the invention taken along line 9—9 of FIG. 11.
Figure 10:
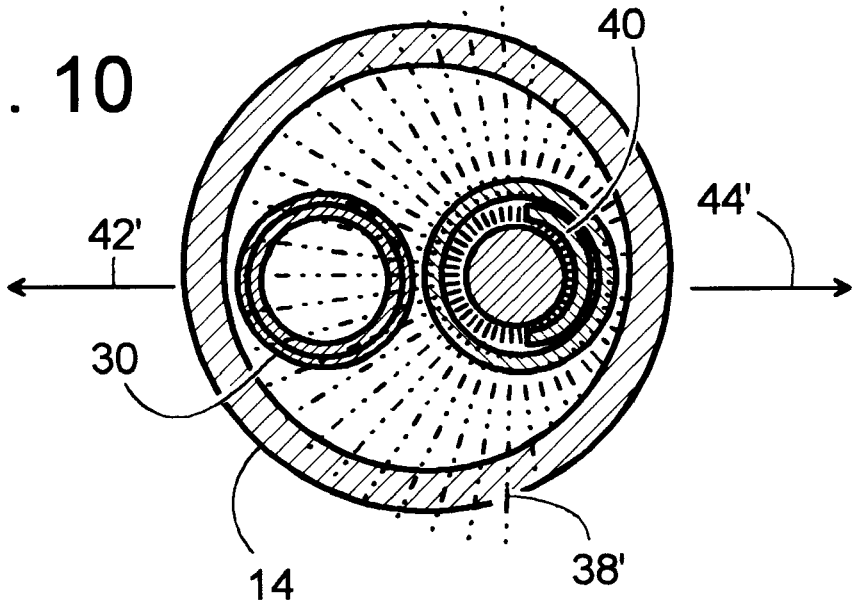
FIG. 10 is a cross-sectional view of the invention taken along line 10—10 of FIG. 9.
Figure 11:
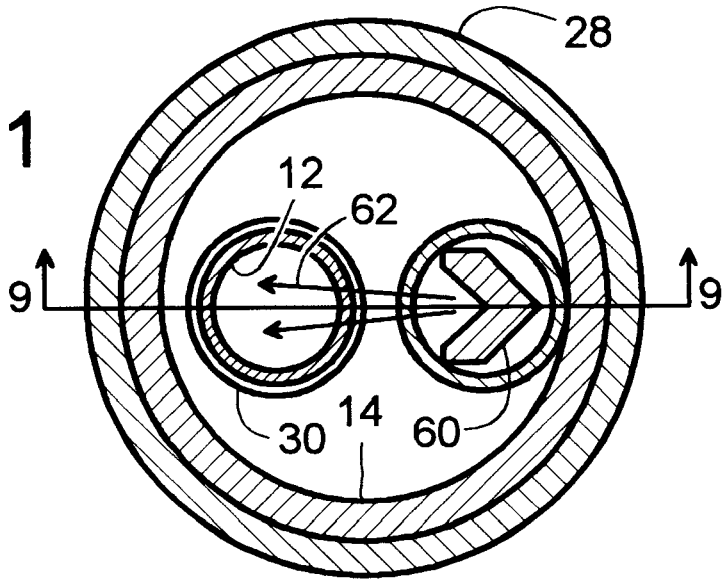
FIG. 11 is a cross-sectional view of the invention taken along line 11—11 of FIG. 9.

The embodiment of FIGS. 9–11 is similar to that of FIGS. 1–4, except shield 40 and charge 60 are rotated 180 degrees in relation to magnet 50 to reverse the forward 42' and rearward directions 44'. This is readily done by selectively rotating individual segments of housing 16, as it is an assembly as opposed to a unitary piece. In the arrangement shown, a field 38' is more disturbed by pipe coupling 30 than by casing collar 28. And charge 60 is directed generally toward pipe string 12 to destroy coupling 30 when properly aligned vertically.

Figure 5:
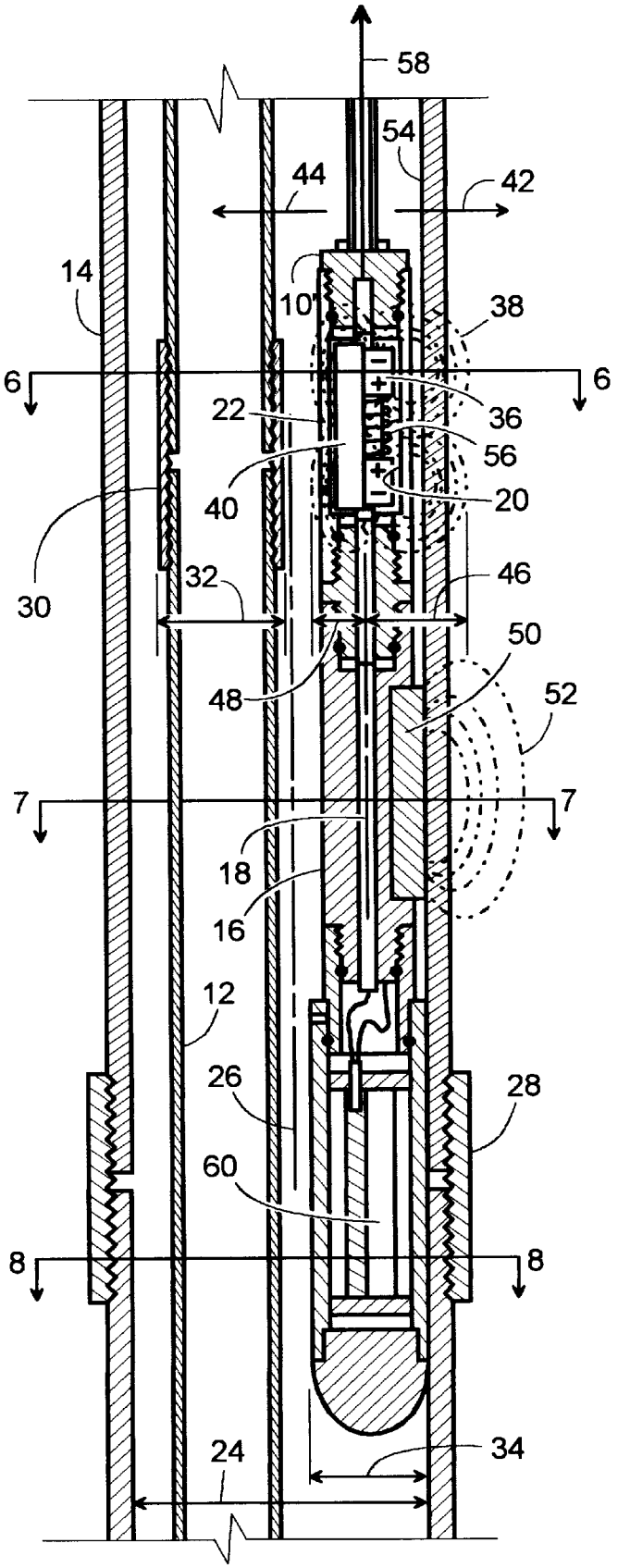
FIG. 5 is a cross-sectional view of the invention taken along line 5—5 of FIG. 7.
Figure 6:
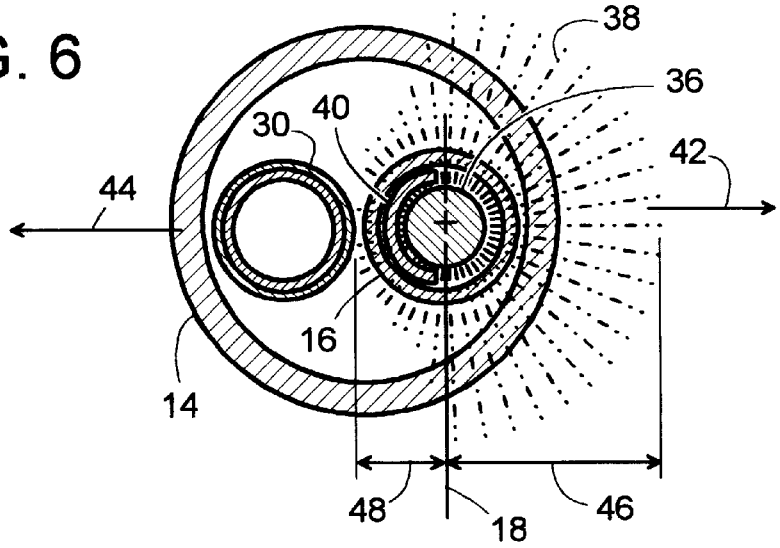
FIG. 6 is a cross-sectional view of the invention taken along line 6—6 of FIG. 5.
Figure 7:
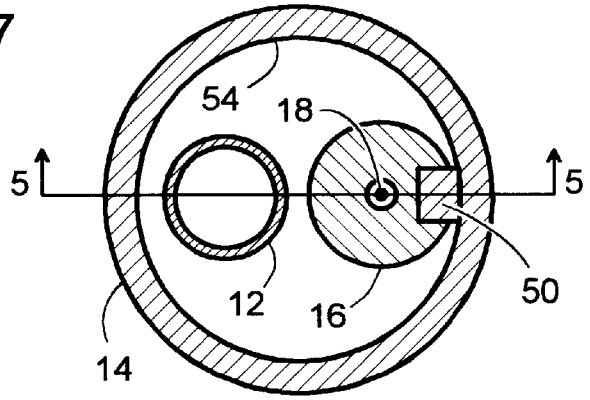
FIG. 7 is a cross-sectional view of the invention taken along line 7—7 of FIG. 5.
Figure 12:
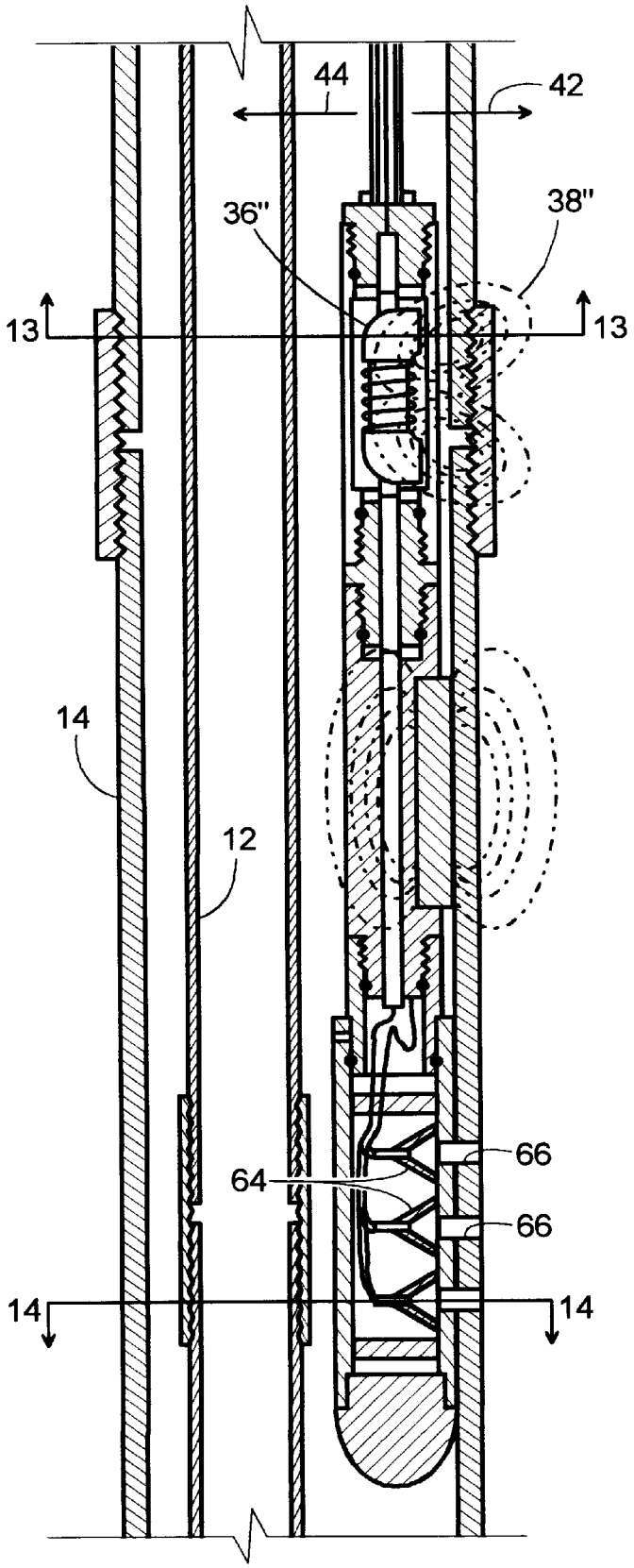
FIG. 12 is a cross-sectional view of yet another embodiment of the invention taken along line 12—12 of FIG. 14.
Figure 13:
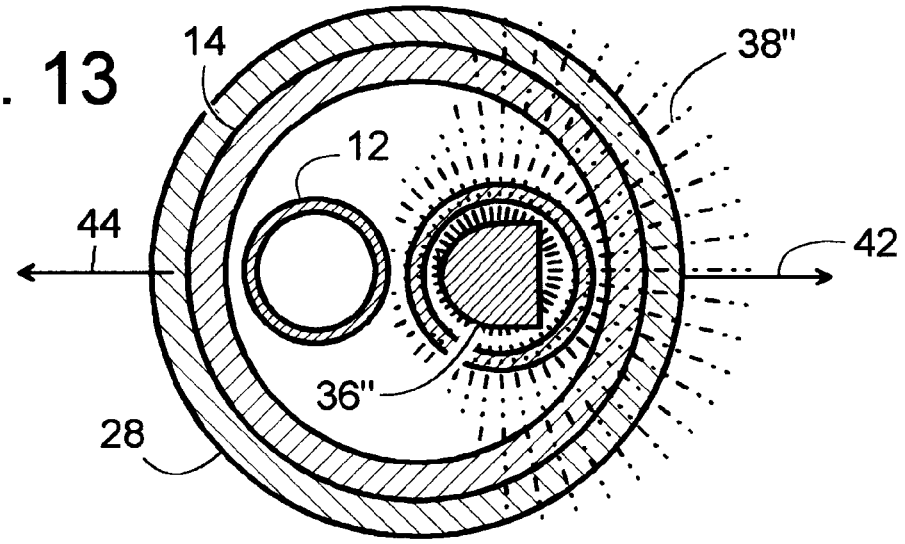
FIG. 13 is a cross-sectional view of the invention taken along line 13—13 of FIG. 12.
Figure 14:
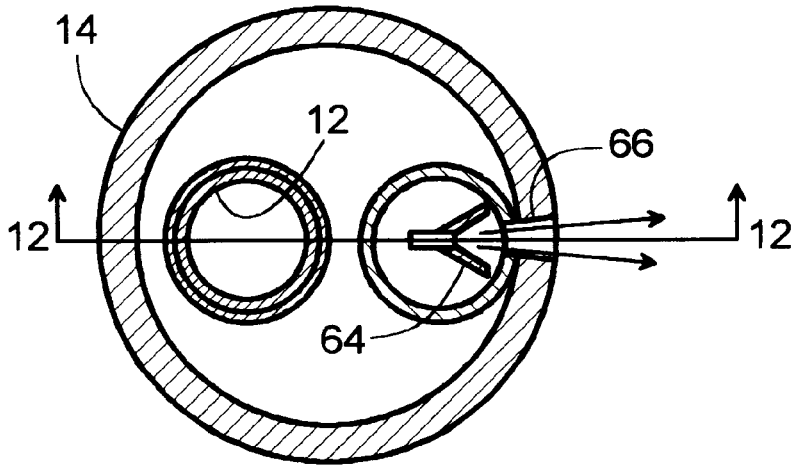
FIG. 14 is a cross-sectional view of the invention taken along line 14—14 of FIG. 12.

For the embodiment of FIGS. 12–14, a first magnet 36" is shaped and situated to project a magnetic field 38" farther in forward direction 42 than in rearward direction 44 to accomplish basically the same result as the embodiment of FIG. 5. In addition, several spaced-apart explosives 64 point in forward direction 42 to create several perforations 66 in a casing 14'. Again, perforations 66 are shown even though they would not actually appear until after charges 64 detonate.

Figure 15:
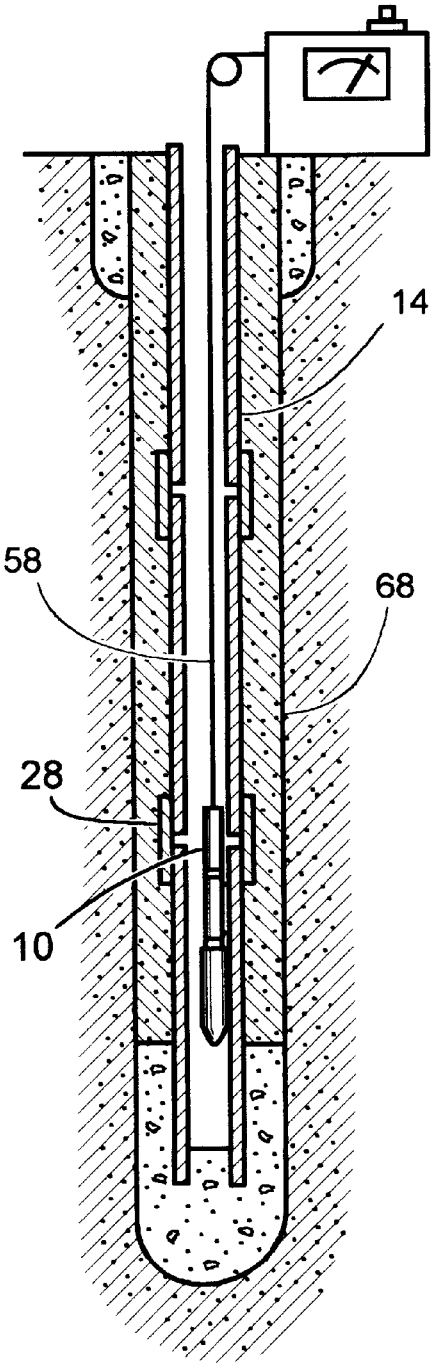
FIG. 15 is a cross-sectional view of a wellbore with the invention aligned to detect a casing collar.
Figure 16:
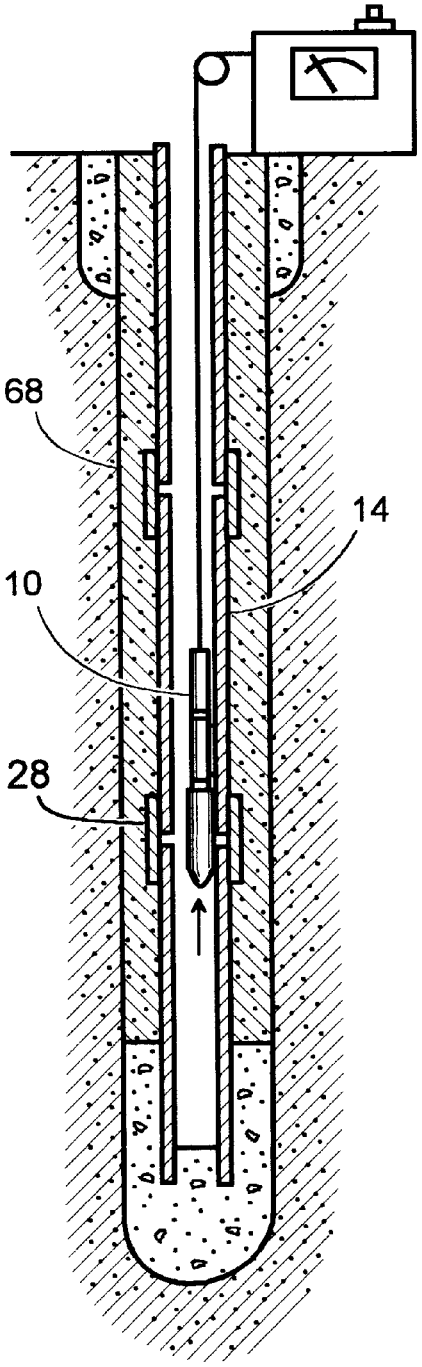
FIG. 16 is a cross-sectional view of a wellbore with the invention aligned to split a casing collar.

FIGS. 15 and 16 illustrate collar locator 10 being repositioned within a wellbore 68 to first detect the location of casing collar 28 (FIG. 11) and then to split it (FIG. 16).

Figure 17:
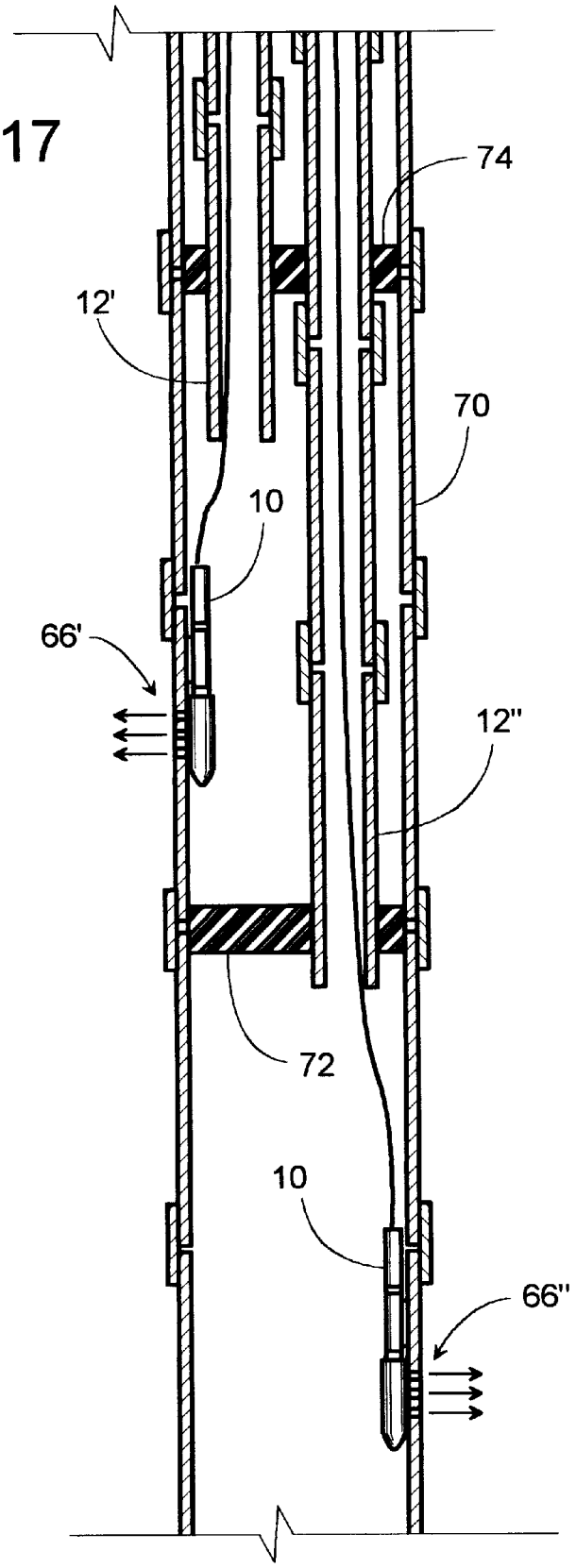
FIG. 17 is a cross-sectional view of a multiple completion wellbore.

It should be noted that in FIGS. 1–14, outer diameter 34 of collar locator 10 is shown larger than the inside diameter of pipe string 12 simply to show more clearly the detail of locator 10. However, in reality, it is preferable to have collar locator 10 sized to fit through pipe string 12. This facilitates its use in a multiple string well 70, as shown in FIG. 17. In this embodiment of the invention, an upper packer 74 sealingly engages pipe strings 12' and 12". A lower packer 72 sealingly engaging pipe string 12" isolates upper perforations 66' from lower perforations 66".

Figure 18:
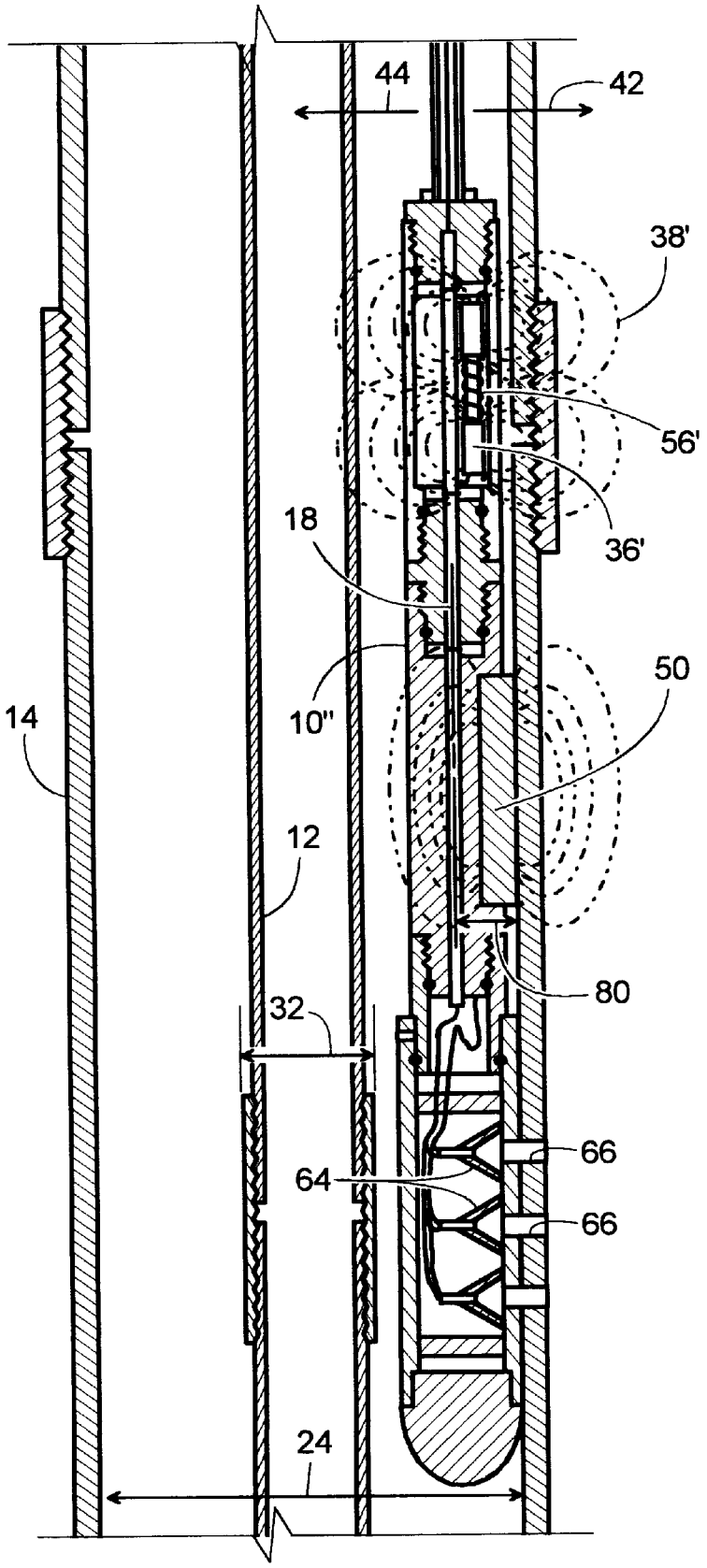
FIG. 18 is a cross-sectional view of another embodiment of the invention taken along its longitudinal centerline.

FIG. 18 shows collar locator 10" similar to collar locator 10 of FIG. 1; however, magnet 36 and coil 56 are replaced by a much smaller cylindrical rare earth magnet 36' and a cylindrical coil 56'. With the greatly reduced size of rare earth magnet 36', its magnetic field 38' extends farther in forward direction 42 simply by virtue of magnet 36' being radially offset from centerline 18.

Magnet 36' consists of samarium and cobalt to provide a powerful magnetic field for its size. Best results are obtained with a samarium cobalt magnet having an intrinsic coercive force of at least 8,000 Hci-oersteds and an energy product of at least 9 mega Gauss oersteds. Magnetic properties at these levels, or above, provide the surprising and unexpected additional side benefit of being further able to detect even corrosion resistant casing collars having an appreciable amount of chromium. Details of samarium cobalt magnets are found in U.S. Pat. Nos. 3,977,917; 4,082,582; and 5,382,303 all of which are specifically incorporated by reference herein.

FIG. 18 shows casing inside diameter 24 minus coupling outside diameter 32 as being more than four times as great as a predetermined distance 80 that magnet 50 protrudes from centerline 18. As the multiplying factor increases beyond four times, the need to radially offset magnet 36' relative to centerline 18 diminishes.

Figure 19:
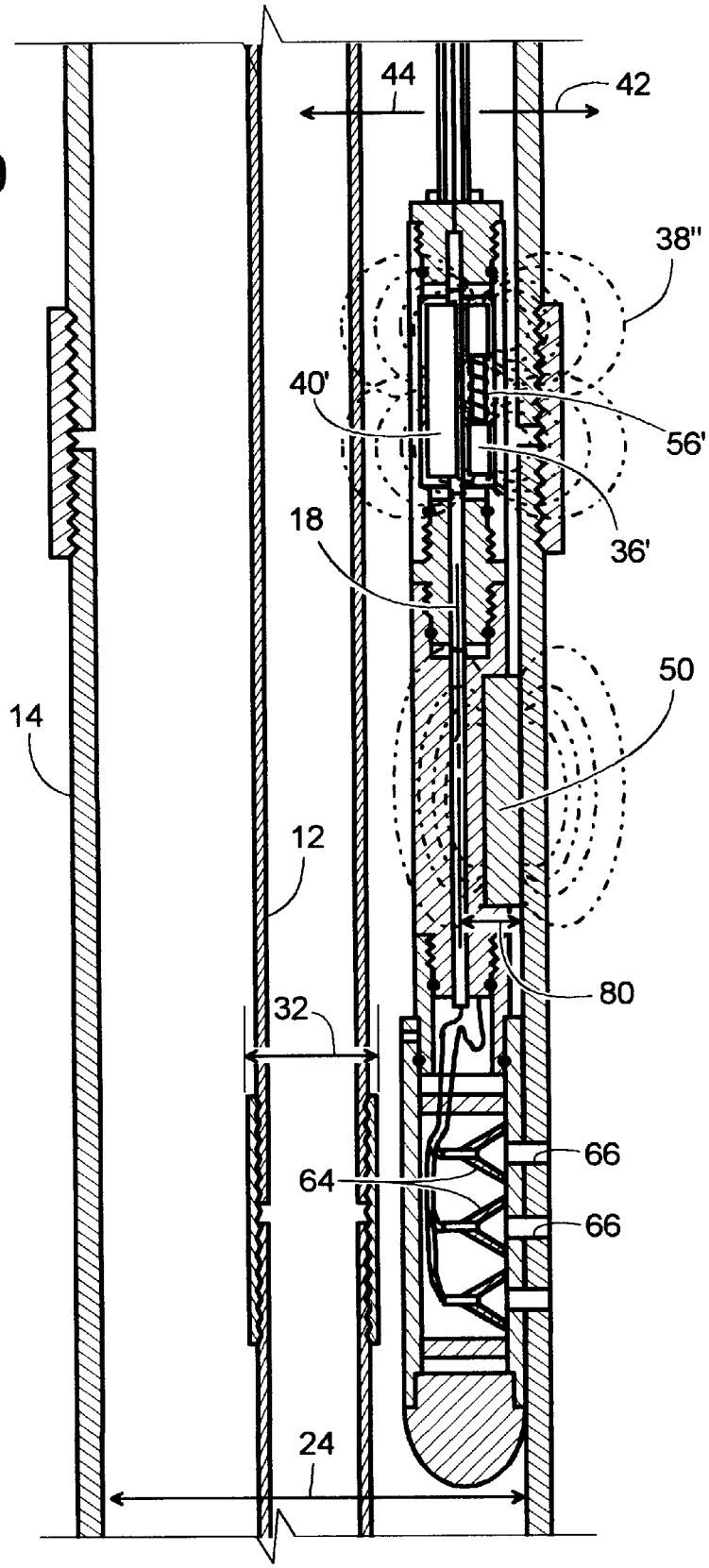
FIG. 19 is a cross-sectional view of yet another embodiment of the invention taken along its longitudinal centerline.

Referring to FIG. 19, as an optional semi-cylindrical magnetic shield 40' shrouds the rear portion of magnet 36', magnetic field 38" moves even farther away from pipe string 12 than field 38' does in the embodiment of FIG. 18.

Figure 20:
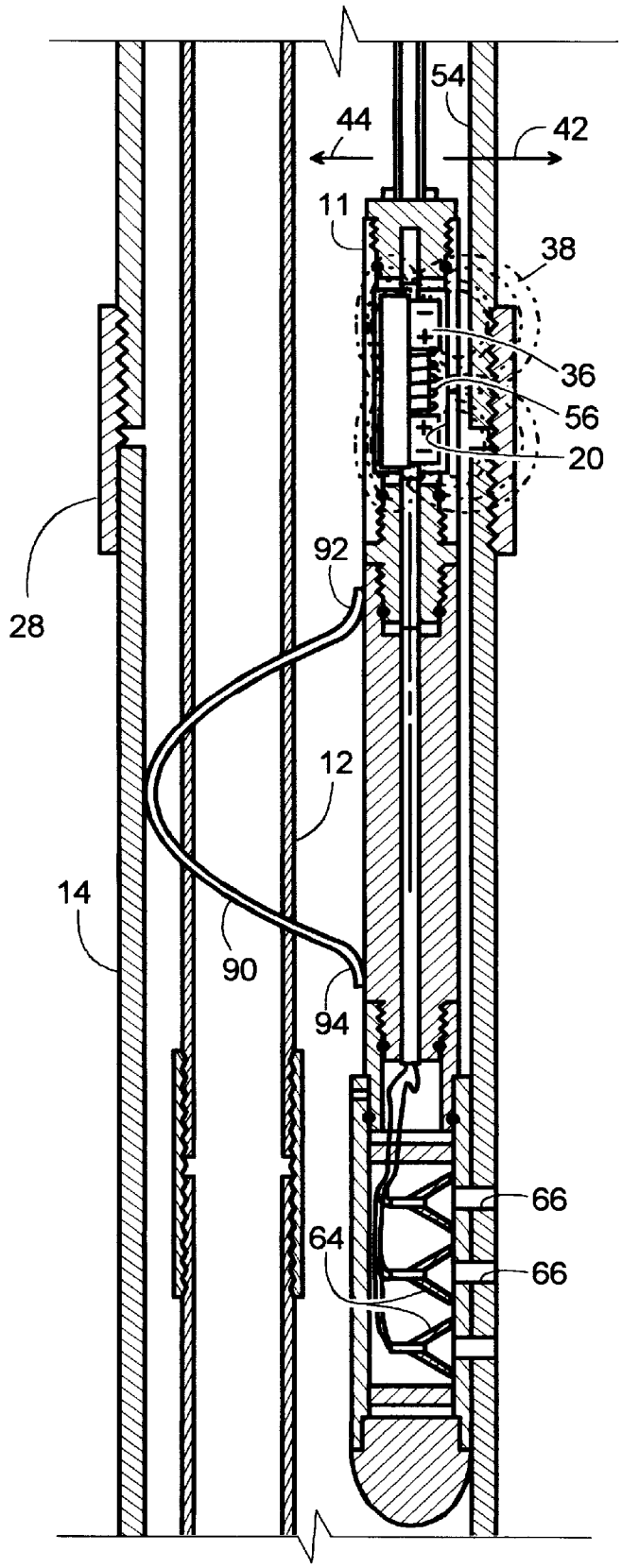
FIG. 20 illustrates an embodiment of the invention that includes a bow spring and a perforation tool.
Figure 21:
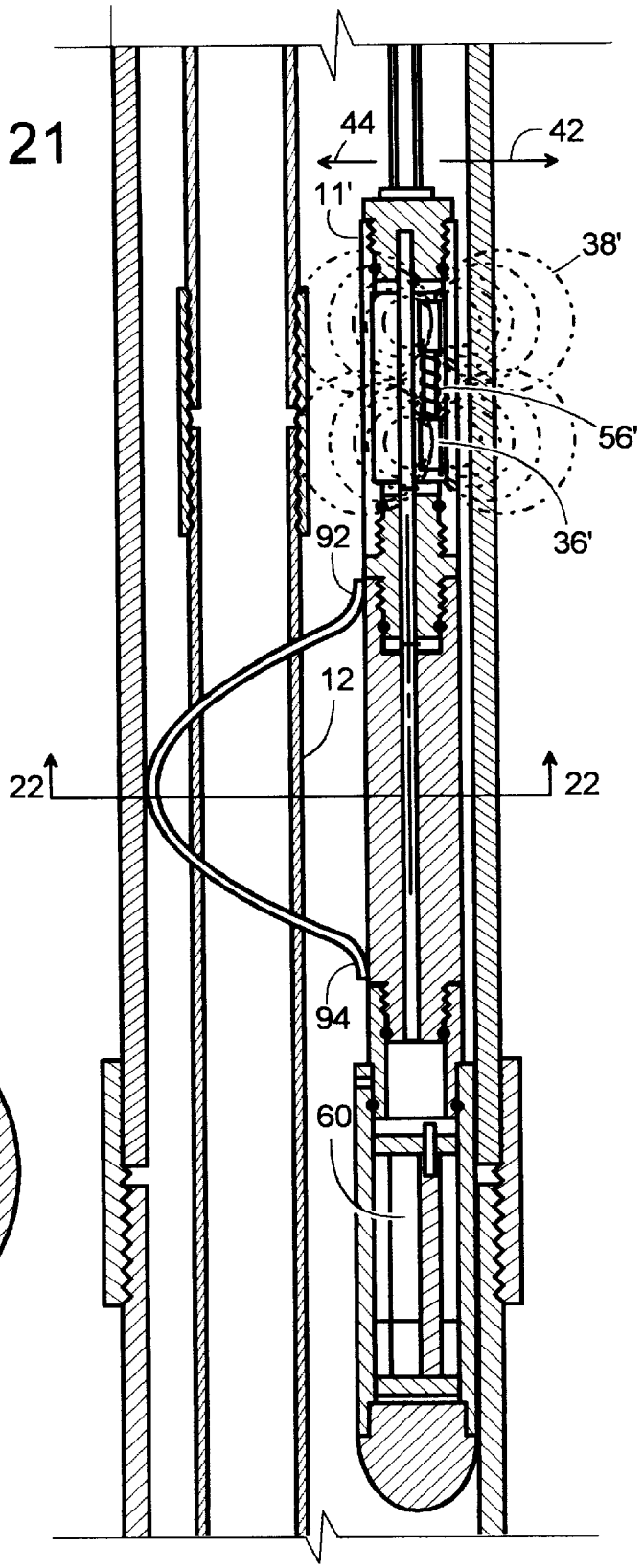
FIG. 21 illustrates an embodiment of the invention that includes a bow spring and a linear charge.
Figure 22:
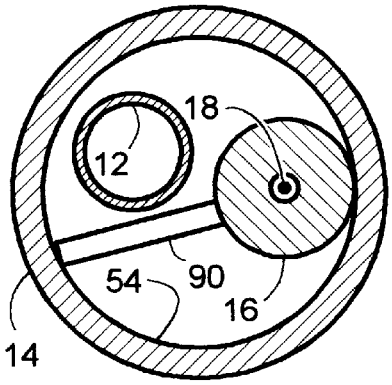
FIG. 22 is a cross-sectional view of the invention taken along line 22—22 of FIG. 21.

In the embodiment of FIG. 20, a flexible metal band, referred to as a bow spring 90, protrudes in rearward direction 44 to urge a collar locator 11 against an inner wall of casing 14. Bow spring 90 is pivotly fixed at one end 92 and attached in a longitudinally sliding direction at an opposite end 94. An example of bow spring 90 would be similar to item 48 of U.S. Pat. No. 4,708,204 which is specifically incorporated by reference herein. In the '204 patent; however, three springs are used to centralize a tool, where only one bow spring 90 is needed to decentralize collar locator 11. In FIG. 20, bow spring 90 is used in conjunction with a perforating tool (items 64), while in FIGS. 21 and 22, bow spring 90 is coupled to a collar locator 11' and used in conjunction with a linear charge.

In view of this disclosure, it should be appreciated by those skilled in the art that a variety of combinations exist to solely sense casing collar location, solely sense pipe coupling location, sense and split a casing collar, sense and split a pipe coupling, or sense a casing collar and perforate the casing.

Although the invention is described with respect to a preferred embodiment, modification thereto will be apparent to those skilled in the art. Therefore, the scope of the invention is to be determined by reference to the claims which follow.

I claim:

1. A directional collar locator for use within a well casing having an internal pipe string, said well casing having a casing inside diameter, a casing longitudinal centerline, and at least one ferrous casing collar, said pipe string having at least one ferrous pipe coupling that has a coupling outside diameter, said directional collar locator comprising:

a tubular housing having a housing longitudinal centerline;

a first magnet coupled to said tubular housing, said first magnet having a first magnetic field extending farther in a forward direction than in an opposite rearward direction as measured radially from and perpendicular to said housing longitudinal centerline;

an electrical circuit associated with said first magnetic field, said electrical circuit providing a feedback signal that changes upon disturbing said first magnetic field by one of said ferrous casing collar and said ferrous pipe coupling depending upon which creates a greater disturbance of said first magnetic field extending in said forward direction; and a second magnet attached to said tubular housing, said second magnet having a second magnetic field that is radially offset from said housing longitudinal centerline in a direction substantially parallel to said forward direction and said opposite rearward direction, said second magnet being adapted to draw said directional collar locator toward said casing inside diameter with said housing longitudinal centerline being substantially parallel to said casing longitudinal centerline, such that said forward direction points substantially away from said casing longitudinal centerline when said second magnetic field is radially offset in said forward direction, and such that said forward direction points substantially toward said casing longitudinal centerline when said second magnetic field is radially offset in said opposite rearward direction, whereby said directional collar locator selectively recognizes said ferrous casing collar and said ferrous pipe coupling depending on where said forward direction points.

2. The directional collar locator of claim 1, further comprising a ferrous shield disposed partially around said first magnet to reduce the extent to which said first magnetic field would otherwise extend in said opposite rearward direction if said ferrous shield were not present.

3. The directional collar locator of claim 1, wherein said tubular housing has a housing outside diameter that is less than said casing inside diameter minus said coupling outside diameter.

4. The directional collar locator of claim 1, wherein said tubular housing includes a chamber having a non-magnetic wall, said first magnet and said electrical circuit being substantially hermetically sealed within said chamber.

5. The directional collar of locator of claim 1, wherein said first magnet is inside said tubular housing and said second magnet is outside said tubular housing.

6. The directional collar locator of claim 1, further comprising an explosive charge inside said tubular housing, said explosive charge having a primary discharge substantially facing said forward direction.

7. The directional collar locator of claim 6, wherein said second magnetic field is radially offset in substantially said forward direction to enable said ferrous casing collar to disturb said first magnetic field and to aim said primary discharge of said explosive charge substantially away from said casing longitudinal centerline and substantially toward said casing inside diameter.

8. The directional collar locator of claim 6, wherein said second magnetic field is radially offset in substantially said opposite rearward direction to enable said ferrous pipe coupling to disturb said first magnetic field and to aim said primary discharge of said explosive charge substantially toward said casing longitudinal centerline, thereby facilitating a partial destruction of said internal pipe string when desire.

9. The directional collar locator of claim 6, wherein said primary discharge of said explosive charge has an elongated shape that runs substantially parallel to said housing longitudinal centerline, whereby said elongated shape facilitates splitting said ferrous casing collar lengthwise.

10. The directional collar locator of claim 6, wherein said explosive charge comprises a plurality of spaced-apart explosives to create a corresponding plurality of spaced-apart holes in said well casing.

11. The directional collar locator of claim 1, wherein said first magnetic field extends farther in said forward direction than in said opposite rearward direction by virtue of said first magnet being situated radially offset to said housing longitudinal centerline and in said forward direction.

12. A directional collar locator for use within a well casing having an internal pipe string, said well casing having a casing inside diameter, a casing longitudinal centerline, and at least one ferrous casing collar, said pipe string having at least one ferrous pipe coupling that has a coupling outside diameter, said directional collar locator comprising:

a tubular housing having a housing longitudinal centerline;

a first magnet coupled to said tubular housing, said first magnet having a first magnetic field extending farther in a forward direction than in an opposite rearward direction as measured radially from and perpendicular to said housing longitudinal centerline;

an electrical circuit associated with said first magnetic field, said electrical circuit providing a feedback signal that changes upon disturbing said first magnetic field by one of said ferrous casing collar and said ferrous pipe coupling depending upon which creates a greater disturbance of said first magnetic field extending in said forward direction; and a bow spring attached to said tubular housing and protruding in said rearward direction, said bow spring being adapted to urge said directional collar locator in said forward direction toward said casing inside diameter, whereby said directional collar locator is more responsive to said ferrous casing collar than said ferrous pipe coupling.

13. The directional collar locator of claim 12, further comprising a ferrous shield disposed partially around said first magnet to reduce the extent to which said first magnetic field would otherwise extend in said opposite rearward direction if said ferrous shield were not present.

14. The directional collar locator of claim 12, wherein said tubular housing includes a chamber having a non-magnetic wall, said first magnet and said electrical circuit being substantially hermetically sealed within said chamber.

15. The directional collar locator of claim 12, further comprising an explosive charge inside said tubular housing, said explosive charge having a primary discharge substantially facing said forward direction.

16. The directional collar locator of claim 15, wherein said primary discharge of said explosive charge has an elongated shape that runs substantially parallel to said housing longitudinal centerline, whereby said elongated shape facilitates splitting said ferrous casing collar lengthwise.

17. The directional collar locator of claim 15, wherein said explosive charge comprises a plurality of spaced-apart explosives to create a corresponding plurality of spaced-apart holes in said well casing.

18. The directional collar locator of claim 12, wherein said first magnetic field extends farther in said forward direction than in said opposite rearward direction by virtue of said first magnet being situated radially offset to said housing longitudinal centerline and in said forward direction.

19. A directional collar locator for use within a well casing having an internal pipe string, said well casing having a casing inside diameter, a casing longitudinal centerline, and at least one ferrous casing collar, said pipe string having at least one ferrous pipe coupling that has a coupling outside diameter, said directional collar locator comprising:

a tubular housing having a housing longitudinal centerline;

a rare earth magnet consisting of samarium and cobalt, said rare earth magnet being situated inside said tubular housing, said rare earth magnet having a first magnetic field;

an electrical circuit associated with said first magnetic field, said electrical circuit providing a feedback signal that changes upon disturbing said first magnetic field by said ferrous casing collar; and a second magnet being distinguishable from said rare earth magnet in that said rare earth magnet has a higher concentration of samarium and cobalt than that of said second magnet, said second magnet being attached to an exterior of said tubular housing, said second magnet protruding a predetermined distance from said housing longitudinal centerline to provide a second magnetic field that is radially offset in a forward direction from said housing longitudinal centerline, said second magnet being adapted to draw said directional collar locator toward said casing inside diameter with said housing longitudinal centerline being substantially parallel to said casing longitudinal centerline, such that said rare earth magnet is closer to said casing inside diameter than said coupling outside diameter upon:

a) said second magnet being drawn against said casing inside diameter, b) said internal pipe string being concentric to said well casing, and c) said casing inside diameter minus said coupling outside diameter being more than four times greater than said predetermined distance.

20. The directional collar locator of claim 19, wherein said first magnetic field of said rare earth magnet extends radially farther in said forward direction than in an opposite rearward direction as measured radially from and perpendicular to said housing longitudinal centerline.

21. The directional collar locator of claim 19, wherein said rare earth magnet is radially offset to said housing longitudinal center line, said rare earth magnet being radially offset in said forward direction.

22. The directional collar locator of claim 19, further comprising a ferrous shield disposed partially around said rare earth magnet to reduce the extent to which said first magnetic field would otherwise extend in said opposite rearward direction if said ferrous shield were not present.

23. The directional collar locator of claim 19, further comprising an explosive charge inside said tubular housing, said explosive charge having a primary discharge substantially facing said forward direction.

24. The directional collar locator of claim 23, wherein said explosive charge comprises a plurality of spaced-apart explosives to create a corresponding plurality of spaced-apart holes in said well casing.

25. The directional collar locator of claim 23, wherein said primary discharge of said explosive charge has an elongated shape that runs substantially parallel to said housing longitudinal centerline, whereby said elongated shape facilitates splitting said ferrous casing collar lengthwise.

* * * * *